United States Patent [19]

Patil et al.

[11] 4,327,554

[45] May 4, 1982

[54] SPILL CONDITION VENTING SYSTEM

[75] Inventors: Ulhas S. Patil, Pittsburgh; Harold F. Honath, Coraopolis; John C. Murphy, Pittsburgh, all of Pa.

[73] Assignee: Pittsburgh-Des Moines Corporation, Pittsburgh, Pa.

[21] Appl. No.: 103,525

[22] Filed: Dec. 13, 1979

[51] Int. Cl.[3] ..... F17C 7/02; B65D 7/22

[52] U.S. Cl. ..... 62/45; 137/565; 137/587; 220/901

[58] Field of Search ..... 62/45, 50, 260; 165/45; 220/901, 429, 452, 444; 137/565, 587

[56] References Cited

U.S. PATENT DOCUMENTS

| | | | |
|---|---|---|---|
| 3,147,878 | 9/1964 | Wissmiller | 220/901 X |
| 3,306,058 | 2/1967 | Keilin | 62/45 |
| 3,595,423 | 7/1971 | Yamamoto | 220/901 X |
| 3,612,332 | 10/1971 | Clapp | 220/901 X |
| 3,748,865 | 7/1973 | Laverman et al. | 62/50 |
| 3,791,164 | 2/1974 | Laverman | 62/50 |

*Primary Examiner*—A. Michael Chambers

*Attorney, Agent, or Firm*—Shoemaker and Mattare, Ltd.

[57] ABSTRACT

A spill condition venting system for a double containment tank includes a control system for controlling, in the event of a spill or an overflow of fluid into the annulus of such double containment tank, the flow of stored fluid into and out of the annulus and for controlling vapor resulting from such spill.

38 Claims, 13 Drawing Figures

SPILL CONDITION VENTING SYSTEM

BACKGROUND OF THE INVENTION

The present invention relates in general to double containment storage tanks, and, more particularly, to a spill control system for double containment storage tanks.

In double wall low temperature liquid storage tanks, product can enter the annular space by any of the following ways: (1) overfilling the inner tank; (2) leakage through the wall of the inner tank; and (3) leakage through the bottom. In the event of leakage through the wall or through the bottom, the liquid will accumulate at the bottom of the annular space.

In known configurations of double wall low temperature liquid storage tanks, the annular space between the two walls is usually filled with granular insulation such as Perlite, or the like. As the liquid accumulates at the bottom of the annulus in a spill condition and progressively increases in height, that liquid will gain sensible heat, that is, stored heat within the body, from every component such liquid contacts, and this sensible heat gain is dependent on temperature difference between the liquid and the component in consideration, and the weight of the component. Due to this heat gain, the low temperature liquid will evaporate, thereby changing phase from liquid to gas. It is a known fact that gases need considerably more volume compared to the corresponding amount of liquid. Depending on the heat gain and the amount of liquid over-fill or leak, the vapor generation can be quite high. In the initial stage, all the components coming in contact with the cold liquid will go through a large temperature drop and therefore, initially, the rate of vapor generation will be very high. Thus, there is need for a system which is capable of handling large volumes of gas without damaging any parts of the tank.

It can be observed from past theory and experience in fluidizing granular material by gases that granular material offers very high resistance to the gas flow. This can be very dangerous to the inner tank, particularly if the cause of the product coming into the annulus is due to a leak from the bottom or wall of the inner tank at the same time that there is very little product in the tank. Resistance to gas flow can result in a pressure buildup under the inner tank bottom which can lift the bottom off its base and endanger the structural integrity of the inner tank.

As mentioned above, the pressure buildup can damage the bottom of the inner tank, but it can also damage the wall of the inner tank. The gas in the granular material can be in the form of small bubbles. In the case of small bubbles, the bubbles might rise through the granular material disturbing the state of that granular material. Small bubbles are almost unavoidable, but a point is reached where bubbles are too large, and, in the limit, the bubbles stretch from wall to wall of the container, that is, completely across the annulus, and act like pistons driving granular material ahead of them until they burst violently at the surface. This phenomenon is known as "slugging".

If slugging is approached when the inner tank is not full of product, the pressure buildup can exceed the external design pressure of the inner tank. Such pressure buildup may result in the buckling of the inner tank wall causing enormous damage.

Therefore, there is need for a system which prevents gas buildup in the annular space of double wall tanks in the event of a spill of liquid, especially low temperature liquid such as a cryogenic liquid, or the like, into the annulus of such double wall tank.

SUMMARY OF THE INVENTION

The overflow system embodying the teachings of the present invention controls vapor generated when liquid from a double containment tank spills into the annulus of that tank.

The vapor generally results from spills occurring in an overfill situation, and accordingly, the system embodying the teachings of the present invention will be termed an overflow system, or a spill condition system for the sake of convenience. However, such terminology is not intended to be limiting.

The system includes an overflow pipe fluidly connecting the inner tank at an overflow level to the annulus at or near the bottom of the tank. Overflowing fluid, such as cryogenic fluid, is thus conducted into the annulus by the present system.

A vapor control system included with the spill control system conducts the vapor generated by the fluid exiting the overflow pipe back into the inner tank to be disposed of by the tank vapor control system.

Alternative embodiments include special vapor pumping systems, liquid control systems, and the like.

In the event of an overfill, liquid will enter a weir provided at the top of the inner tank and will flow through the overflow handling system provided for such a spill event and will accumulate at the bottom of the annular space.

The vapor control system presents a flow path to the vapor which has less flow resistance than does a path through the granular material in the annulus. This reduced flow resistance is achieved by including glass fiber blankets in the vapor control system. The blankets provide compaction control and have less resistance to gas flow than does the granular material.

However, these blankets do not have enough flow capacity for accommodating the total amount of gas flow generated in a spill condition. Therefore, the venting system is mechanically designed to have even less flow resistance to vapor flow than does the glass fiber blanket, and has an area equal to the required design area for the expected vapor flow. This result is accomplished by installing a metal cage around the inner tank wall and between the wall and the glass fiber compaction control system blankets. The cages form annular spaces or channels between the inner tank wall and the blankets for accommodating gas flow, and the only resistance to flow is due to friction, without interference of any sort. These cages do have openings large enough to allow glass fiber blankets to enter the gas flow path and obstruct the gas flow. Therefore, a load distributor, again with low resistance to vapor flow, is provided to cover the openings of the cage. In the preferred embodiment, this cover includes a layer of expanded metal wrapped on the cage. This expanded metal has low resistance to gas flow, and also has good load bearing and load distribution characteristics. The glass fiber blanket has a triple function: (1) compaction control; (2) one of the paths for gas flow; (3) providing a filter for the gas which is flowing in the venting system and restricting granular materials from falling into the venting system and thereby obstructing gas flow.

A material which offers less resistance to gas flow is used in lieu of granular insulation for some part of the annulus at the bottom of that annulus. The design criterion for this material is that such material be a good insulator compared with granular insulation. This design criterion is achieved by replacing granular insulation in some part of the bottom of the annulus by a glass fiber material which is a good insulator and which offers very low resistance to gas flow. This glass fiber serves the function of directing the high volume of gas generated in initial evaporation of spilled liquid to the venting system.

In the preferred embodiment, a glass fiber filter is provided on top of the glass fiber located at the bottom of the annulus. The glass fiber at the bottom of the annulus is installed so that the fibers are parallel to the inner and the outer tank walls. Resistance to the gas flow is therefore less when flow is in the direction of the orientation of the fibers. Additionally, compressive strength is higher for such fiber orientation, which is an additional feature since there is a heavy load of granular material on this glass. If this glass fiber is provided without a filter, grain particles from granular material might enter into the vapor venting system and clog that system, thereby obstructing gas flow through the venting system.

Once the gas flows up through the venting system, that gas is directed into the inner tank by cutting openings into the very top part of the inner tank wall. These openings have an area exactly equal to the venting system cross-sectional area. Also, the very top part of the compaction control system glass fiber blanket surface, which is exposed to granular insulation, is covered with a vapor deflector in order to direct the gas through the glass fiber blanket and venting system into the inner tank. This vapor deflector extends for approximately eight to ten feet from the top of the tank, there terminating, so that the remaining portion of the blanket is left to contact the granular insulation. Cold gases are thus prevented from flowing through the top part of the granular insulation and establishing contact with the dome roof structure, which will endanger the integrity of that roof and thereby create a potentially disastrous situation.

Finally, the vent gases directed into the inner tank are taken out of the inner tank through the emergency venting system connecting the inner tank, through the suspended deck roof, to the dome roof.

Further, massive vapor handling is not the only system of great importance from a safety point of view in double wall tanks. Another very important system in reducing the mass vapor generation rate is one which decreases the volume of spilled liquid. A reduced volume of spilled liquid reduces the volume of generated vapor.

Alternative embodiments of the present system therefore include means for reducing the volume of spilled liquid. These alternative embodiments include means for pumping the liquid out of the annulus. As discussed above, the annulus of a double wall tank is generally full of granular insulation. In pumping liquid out of granular material, all sorts of problems are encountered. Pumping a slurry of granular material may result in failure of the pumping system. To prevent such failure causing situations, a filtering system is provided. Again, as described earlier, the area in the bottom of the annulus is replaced with glass fiber. Glass fiber is used as a filter for a pump inlet pipe. The glass insulation around the pump is still supported in this embodiment. Therefore, a cage made out of expanded metal is installed at the end of the pump intake pipe. This cage is empty and serves as a sump to collect the spilled liquid from where that spilled liquid is pumped out without any difficulties being encountered. This liquid may not be as pure as that liquid located in the inner tank. Therefore, it may be necessary to filter it prior to subsequent use and/or storage, and suitable filter systems can be used to accomplish this filtering step.

OBJECTS OF THE INVENTION

It is a main object of the present invention to minimize the effect of spills in a double containment tank.

It is another object of the present invention to prevent damage to a double containment tank due to overflow of liquid from the tank into the annulus thereof.

It is yet another object of the present invention to conduct vapor out of the annulus of the double containment tank.

It is still another object of the present invention to control liquid buildup in the annulus of a double containment tank due to a spill.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
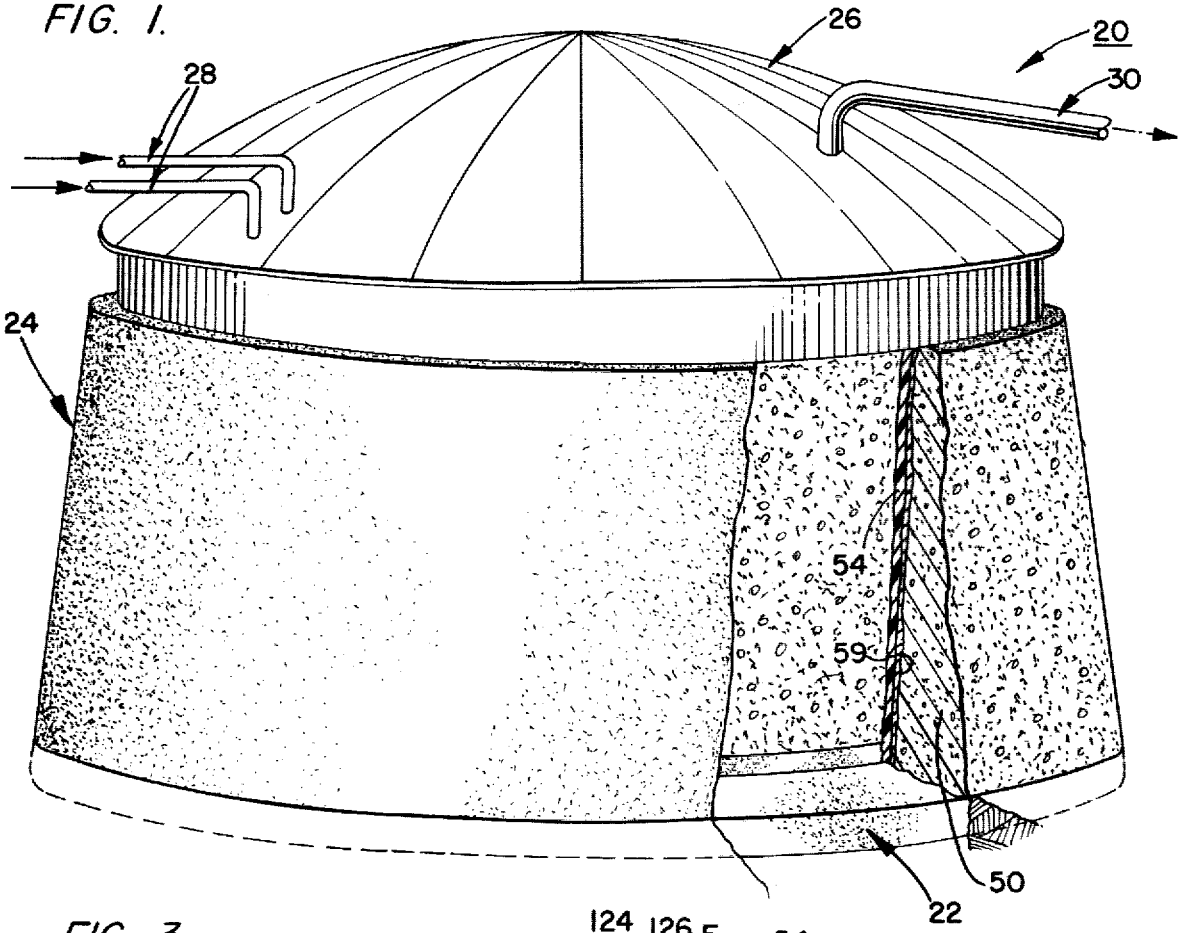
FIG. 1 is a perspective elevation showing the double containment tank embodying the teachings of the present invention.

Shown in FIG. 1 is a double containment tank 20 which includes a base 22, a wall section 24 and a dome roof 26. Fluid flow systems associated with the tank 20 include liquid inlet lines 28 and vapor line 30.

Figure 3:
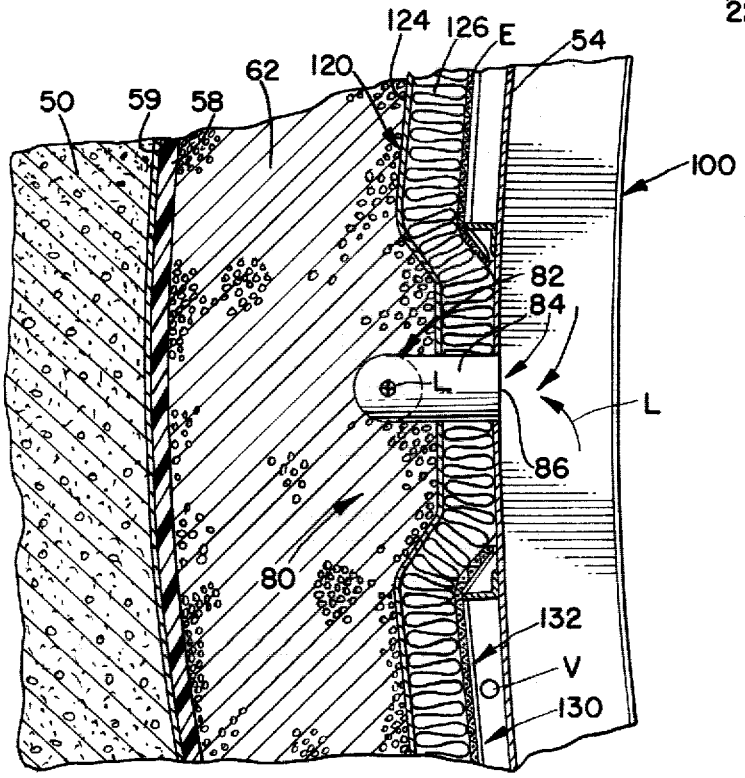
FIG. 3 is a view taken along line 3—3 of FIG. 2.
Figure 2:
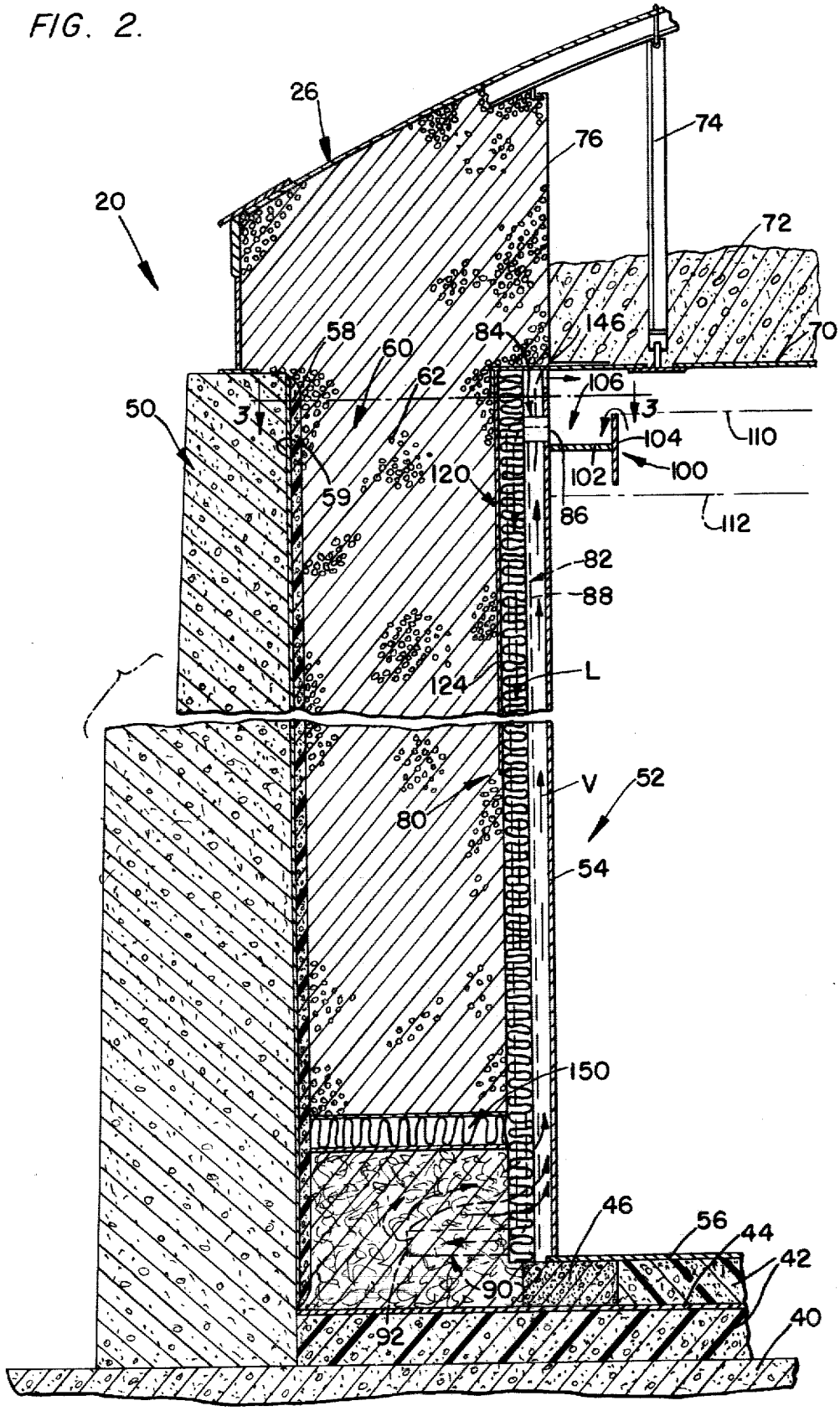
FIG. 2 is an elevation showing the double containment tank embodying the teachings of the present invention.

As shown in FIGS. 2 and 3, the tank 20 includes a concrete bottom 40 supporting a pair of load bearing bottom insulation layers 42 separated by a metal outer tank bottom 44. A concrete support ring 46 is also shown in FIG. 2. The tank includes an outer wall 50, formed of concrete or the like, and a metal inner tank 52 having a wall 54 and a bottom 56. A layer of polyurethane foam is applied to a liner 59 which is attached to the inner surface of the outer wall.

The inner tank wall 54 is spaced from the outer wall 50 to define an annulus 60 therebetween. Granular insulation 62, such as Perlite, or the like, is located in annulus 60.

A suspended deck 70 is located within the tank, and insulation 72 is located on the top of the deck. Deck suspension braces 74 and an insulation support 76 are also included in the tank.

An overflow system 80 is best shown in FIGS. 2 and 3 to include a downcomer pipe 82 fluidly attached at one end section 84 thereof to the interior of the inner tank 52 via overflow port 86 defined in the inner tank wall 54 near the top thereof, and includes a central section 88 extending vertically downward adjacent, but spaced from, inner tank wall 54. The downcomer pipe has a lower end section 90 having an outlet end 92 thereon. The outlet end 92 is directed away from the inner tank and is located in the annulus 60 so that fluid from the downcomer pipe flows into the insulation 62 located in the annulus 60 adjacent the tank lower end.

A rim girder 100 includes a base 102 and a flange 104 which forms a weir to control flow. Interior portion 106 of the girder is in fluid communication with the overflow port 86. The rim girder thus defines an overflow level 110 which, of course, is above a normal operating level 112 shown in FIG. 2.

Fluid contained within the tank 52 will overflow the weir and flow into the downcomer pipe 82, which can thus be termed an overflow pipe, to be deposited near the base of the tank. The small spacing between the overflow pipe and the tank wall 54 prevents, or at least inhibits, vapor generation within the downcomer pipe.

As shown in FIGS. 2 and 3, the overflow system 80 includes a compaction control blanket 120. The blanket is wrapped around the inner tank wall 54, and is preferably glass fiber. The blanket serves at least three functions, as was discussed above. As shown in FIGS. 2, 3, 7 and 13, a layer 124 covers the blanket for a portion of the length of the wall, preferably eight to ten feet. It is also noted that other embodiments of the presently disclosed overflow control system have blankets which cover only part of the tank wall, or no blankets at all. Coverage of only that part of the tank wall above or below a specified height is possible using such embodiments.

Figure 4:
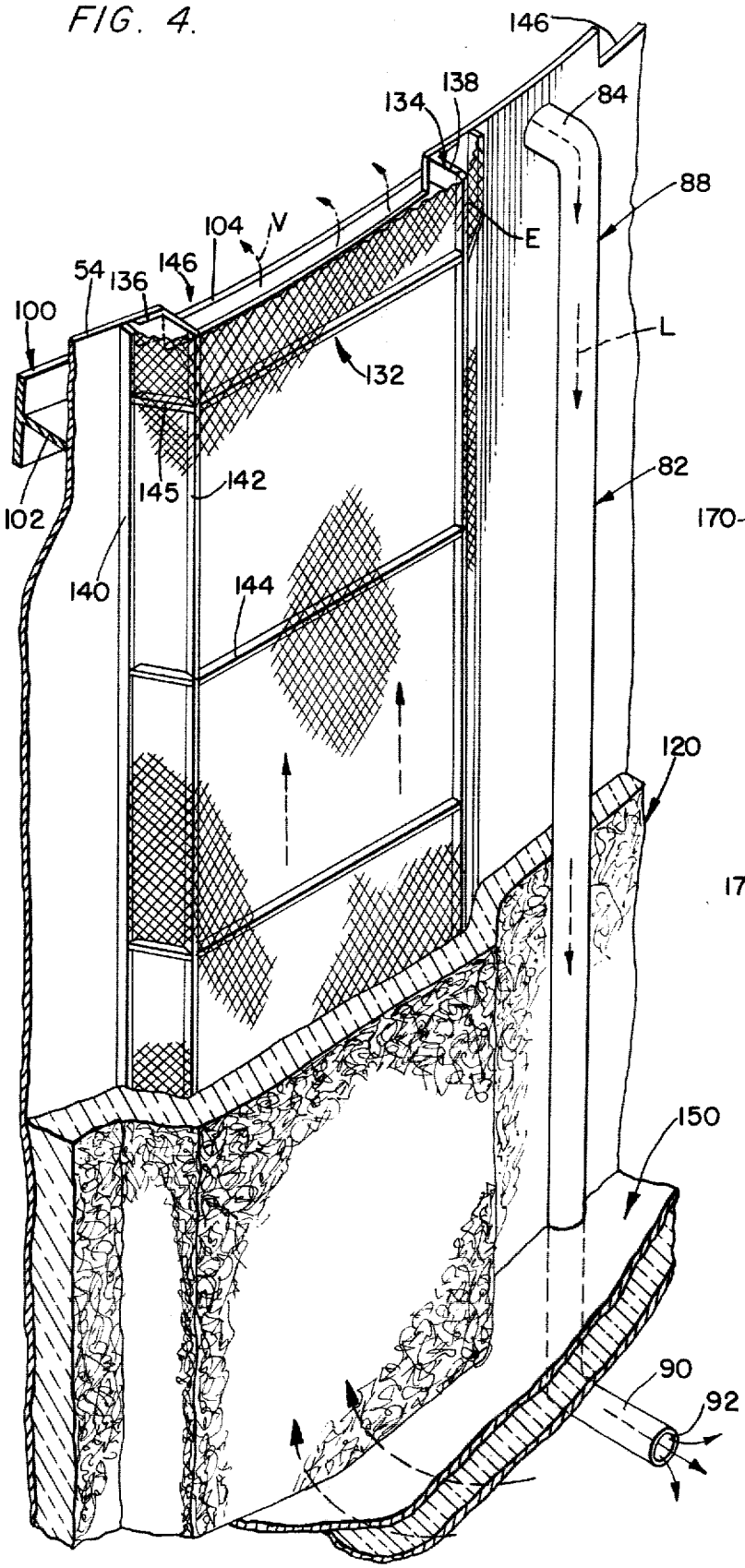
FIG. 4 is a perspective view of an overflow control system embodying the teachings of the present invention.

As shown in FIG. 3, the blanket 120 is corrugated to form a plurality of ducts 130 while adjacent portions of the blanket contact, or are located closely adjacent, the tank wall 54. The corrugations, and thus the ducts, extend essentially the entire height of the tank as indicated in FIG. 4. Support members 132 serve to define the corrugations forming the ducts.

The support members are best shown in FIG. 4 and include angle brackets 134 each having a base 136 mounted on the tank walls 54 and a back 138 extending outwardly therefrom. At least four angle brackets are used on each duct. A pair of vertical stiffeners 140 are each attached to the back of the angle brackets and extend essentially vertically to support the edges of each duct. The support means for each duct also includes vertical support bars 142, and a plurality of horizontal support bars 144, and crossbraces 145.

As shown in FIGS. 3 and 4, the overflow pipe is located in the corrugation between a pair of adjacent ducts, and, as best shown in FIG. 4, the top of the inner tank wall is notched adjacent each duct to define a vapor opening 146. The ducts are therefore vapor ducts. A plurality of overflow pipes is preferred.

An annular filter 150 is formed similar to the compaction control blanket 120 and is disposed horizontally within the annulus 60. The filter controls vertical compaction of the granular insulation and provides a flow control element for the vapor generated at or near the base of the tank by the injection of fluid from the tank 52 into the granular insulation, as was discussed above. As was discussed above, fibers can be located adjacent the conduit outlet end 92 which are oriented parallel to the tank walls so that resistance to gas flow is reduced when the gas flow is in a direction parallel to the tank walls. The fibers within the filter 150 can also be oriented to provide suitable flow resistance. An outer layer 124 is attached to the outer portion of the top of the compaction control blanket and serves as a vapor deflector to deflect the gas into the tank 52 through openings 146.

As shown in FIGS. 2, 3 and 4, when the fluid level inside the tank 52 rises above the overflow level, some of that fluid flows over the weir into the interior space 106. When sufficient fluid is in the space 106, some of that fluid flows into the overflow pipe via overflow port 86 as indicated in FIG. 2 by arrows L.

The fluid then exits the overflow pipe via end 92 and is injected into the annular space 60. The injected fluid generates vapor V which tends to rise within the annular space 60. Due to the difference in flow resistance between a path upwardly through the granular insulation 62 and a path upwardly through a vapor duct 130, the vapor flows into the vapor ducts as indicated in FIG. 2. The vapor in each vapor duct flows upwardly adjacent the walls 54 and exits the duct via vapor opening 146.

The vapor exiting the vapor openings 146 flows back into the tank 52 to be disposed of by the vapor control system associated with that tank. The vapor control system associated with the inner tank can include the vapor line 30 shown in FIG. 1 and can include suitable pumping means. As was discussed above, suitable filters are included to ensure that granular material is not entrained in the vapor flowing in the vapor control system.

Figure 5:
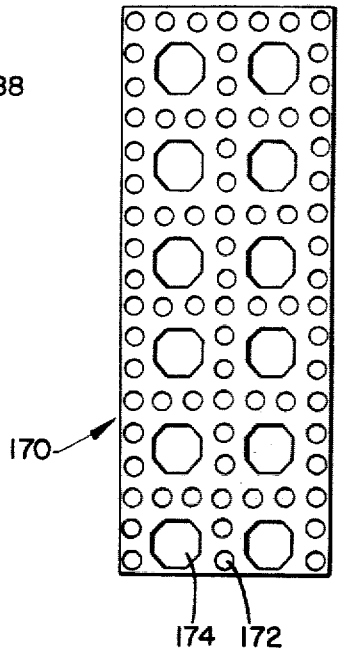
FIG. 5 is an alternative embodiment of a covering for the cage used in the overflow control system embodying the teachings of the present invention.
Figure 6:
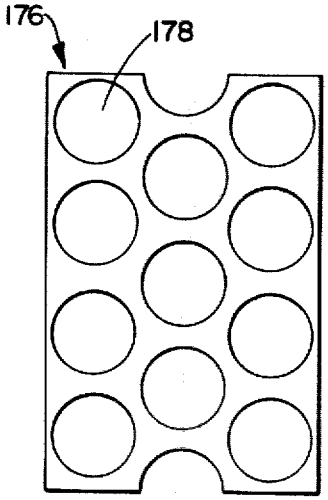
FIG. 6 is an alternative embodiment of a covering for the cage used in the overflow control system embodying the teachings of the present invention.

Expanded metal supports the compaction control blankets 120, and it is noted that instead of expanded metal, perforated plates can be used to support these compaction control blankets. Two forms of perforated plates are shown in FIGS. 5 and 6, respectively, while an expanded metal grating E is shown in FIG. 4. Other forms of perforations can be used. The plate 170 in FIG. 5 includes circular perforations 172 and polygonal perforations 174 which can be of any shape, but should be small enough to prevent the blanket from entering the flow path. The plate 176 shown in FIG. 6 includes a plurality of equal sized circular perforations 178.

It is also noted that while the preferred shape of the vapor ducts is trapezoidal, other shapes, such as rectangular, or the like, can also be used. Furthermore, instead of a plurality of vapor ducts, of whatever shape, a single continuous annular vapor duct is used in another form of the overflow system. The overflow pipe will be located in the annular space defined by this annular vapor duct. Of course, a plurality of overflow pipes can be used with this embodiment as well.

It is here noted that while the preferred location of the overflow pipe is outside the blanket 120, the pipe can also be located within that blanket.

Figure 9:
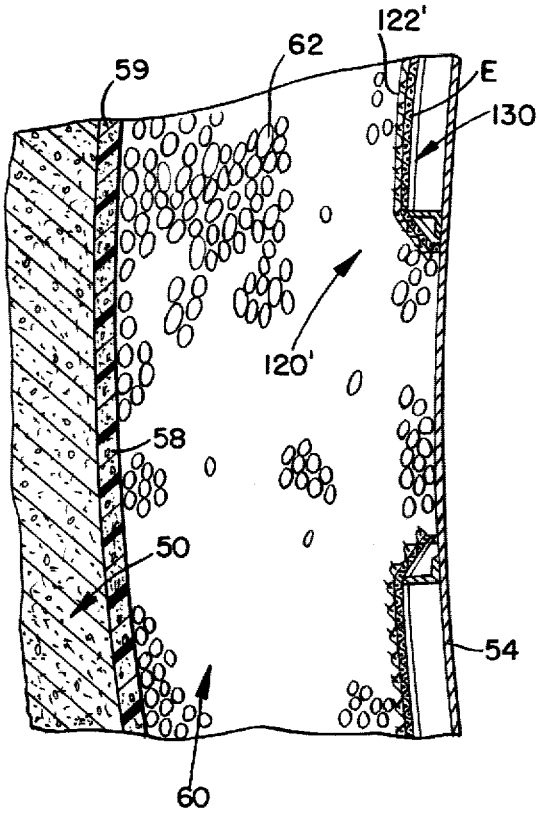
FIG. 9 is an alternative embodiment of the double containment tank overflow control system embodying the teachings of the present invention.

When a compaction control system is not used, a fabric layer 122' is used on the cage surface as shown in FIG. 9.

Figure 10:
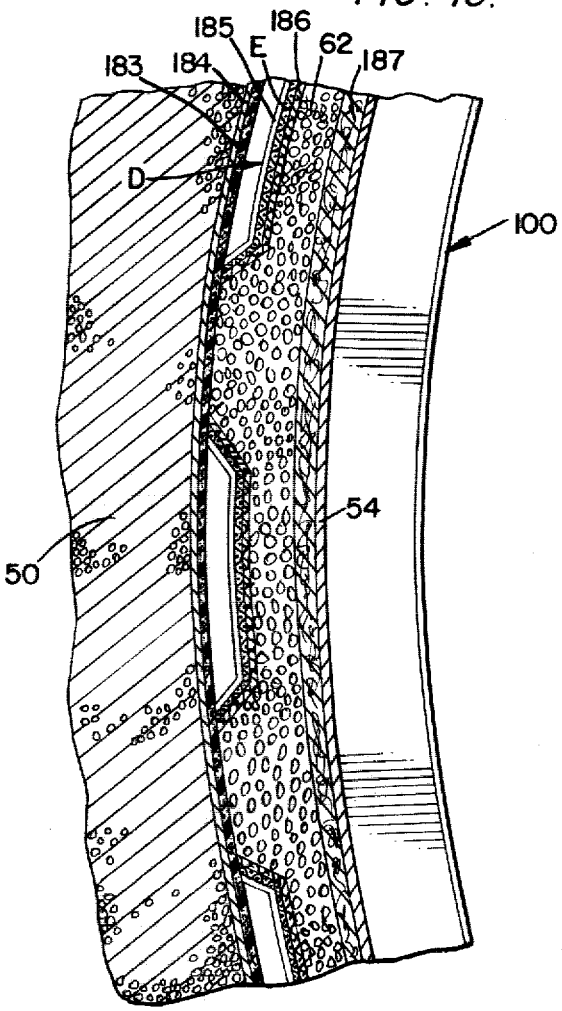
FIG. 10 is an alternative embodiment of the double containment tank overflow control system embodying the teachings of the present invention.

As shown in FIG. 10, a duct defining means D is mounted on the wall 50 in another form of the invention. The duct defining means mounted on the outer wall also includes corrugations in this form of the invention. The corrugations define vapor ducts similar to the vapor ducts 130, and are fluidly connected to the inside of tank 52 so that vapor flowing upwardly in the ducts on the wall 50 flows into the tank 52 to be disposed of by the tank vapor control system. As shown in FIG. 10, a steel liner 184 is mounted on the inside of outer tank wall 50, and a layer of polyurethane foam 183 is applied on it. A cage defining means 185, similar to the cage defining means shown in FIG. 4, is mounted on the foam and defines the corrugations. A metal grating E is mounted on the cage defining means, and a layer 186 of cloth fiber, or the like, covers the grating E. Granular insulation 62 is located in the annulus, and a glass fiber layer 187 is mounted on the tank inner wall.

The outer tank metal liner inside surface has surface protection insulation for the full height thereof, or for part of the height thereof in other embodiments. The outer tank 50 is steel in one embodiment of the invention.

Yet another embodiment of the overflow system includes a separate vapor disposal means. The vapor in the system is thus collected in the vapor flow channels and disposed of by means of a system which is separate from that system used to dispose of vapor from tank 52.

In another embodiment of the present invention, the inner tank 52 has a dome roof instead of the suspended deck shown in FIG. 2. In this embodiment, the inner tank does not overflow, and vent gases of the annulus are not dumped into the inner tank via a notched vapor opening such as opening 146, but includes a predesigned vapor control system which includes a separate piping system in one form thereof.

Figure 7:
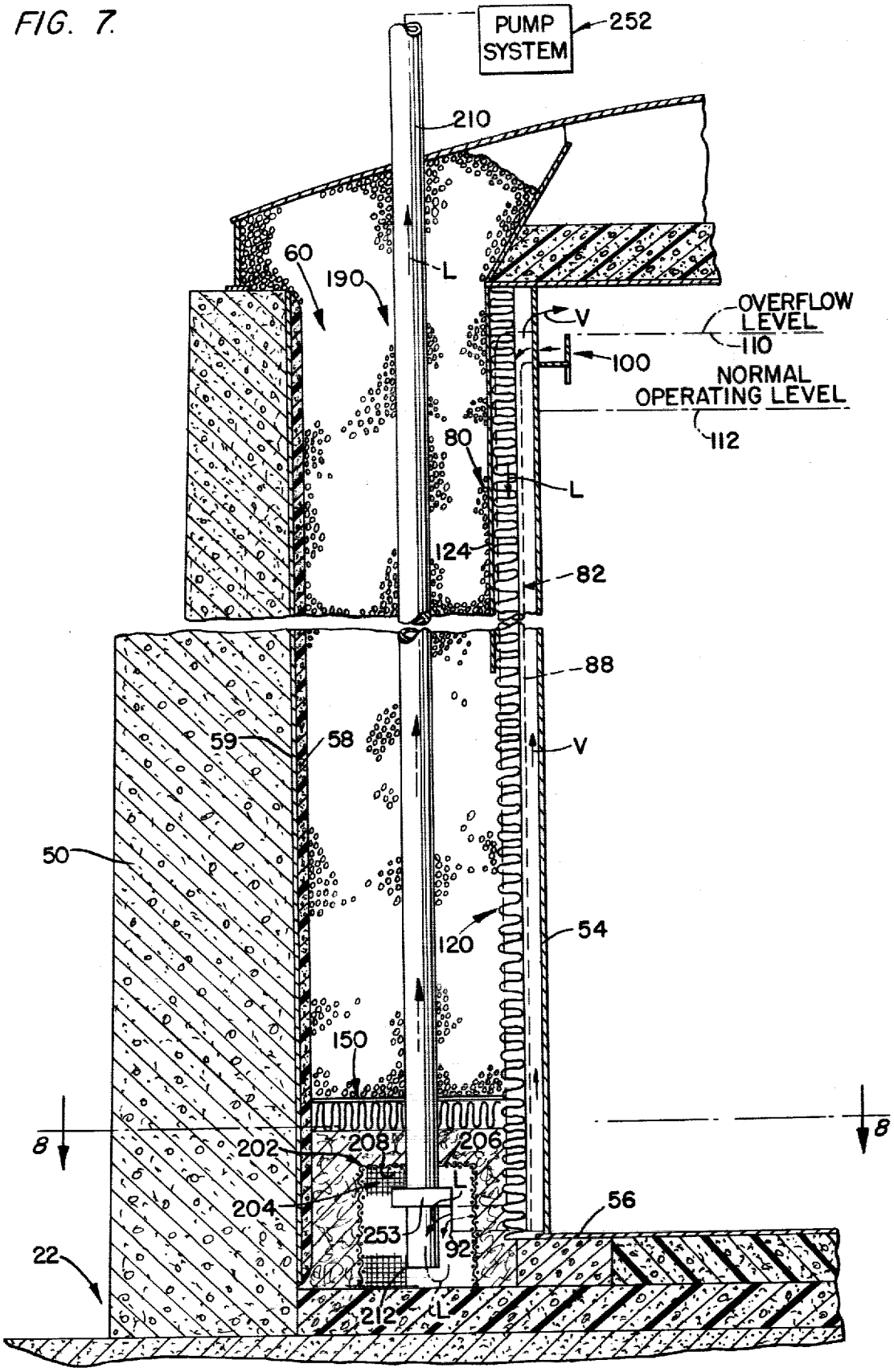
FIG. 7 is an alternative embodiment of the double containment tank overflow control system embodying the teachings of the present invention.
Figure 8:
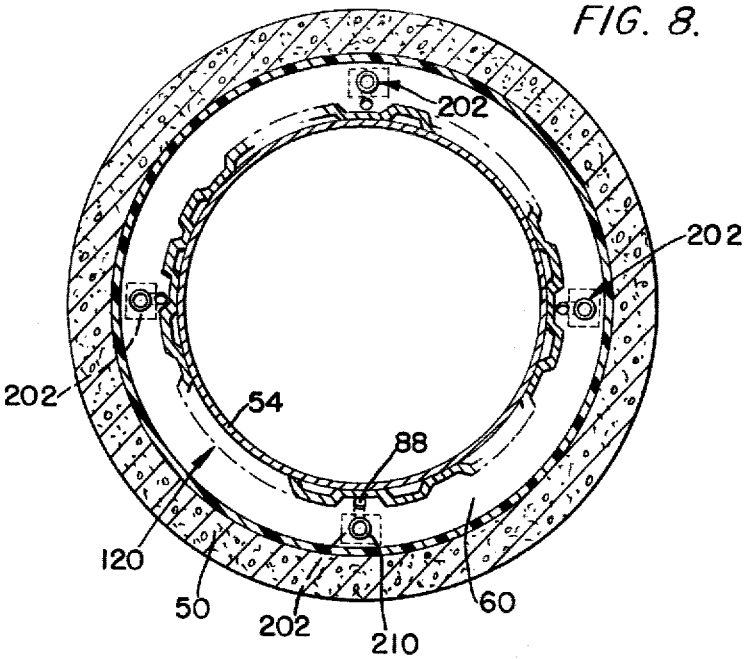
FIG. 8 is a view taken along line 8—8 of FIG. 7.

Shown in FIGS. 7 and 8 is yet another embodiment of the overflow control system of the present disclosure. As shown in FIG. 7, a liquid control system 190 is included with the overflow control system 80. The liquid control system removes liquid from the annular space 60 and includes a plurality of liquid product traps 202 mounted on the tank base 22 to accommodate the overflow pipe end 92. Each trap includes a polygonal cage 204 which has an expanded metal outer layer 206 and compacted glass fiber 208 on the outside surface of the layer 206. A liquid riser pipe 210 is mounted on the tank walls to have the lower end 212 thereof located within the cage 204. The pipe 210 extends upwardly from the cage and is fluidly connected to a liquid handling system 252 located externally of the annulus, and preferably externally of the tank 20. A submersible pump 253 is located near the bottom of the pipe 210 to pump fluid through that pipe. It is noted that the cage 204 can be surrounded by suitably directed glass fiber fibers, as was above-discussed.

Liquid buildup is prevented by the system 190. The lower end of the riser pipe is spaced from the base a distance sufficient to prevent undue liquid buildup. The liquid control system works in conjunction with the vapor control system disclosed above.

Figure 13:
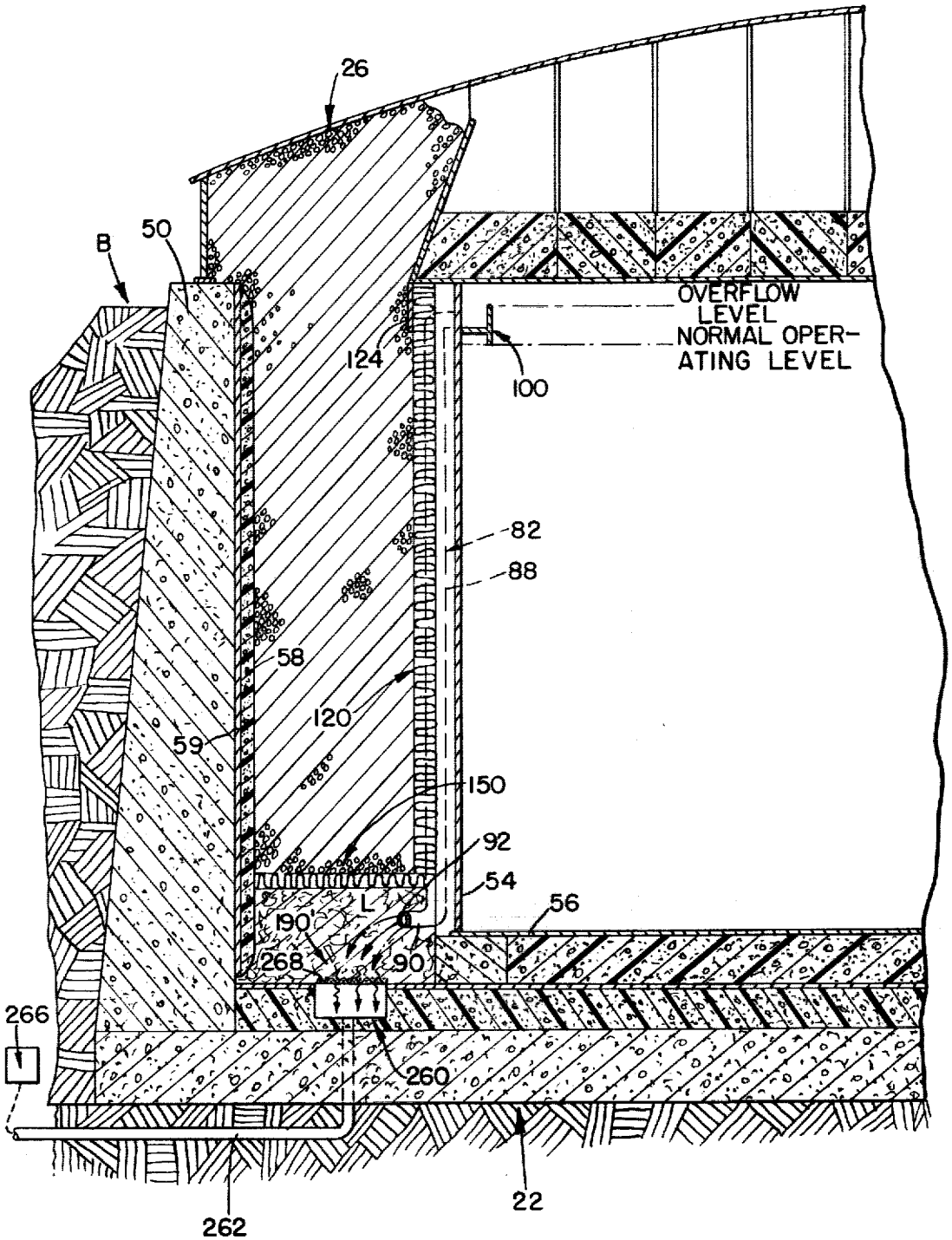
FIG. 13 is an alternative embodiment of a double containment tank overflow control system embodying the teachings of the present invention.

Shown in FIG. 13 is a variation of the liquid control system 190, and denoted by the reference indicator 190'. The liquid control system 190' includes a gravity drain system, such as a sump 260 located subjacent the overflow pipe end 92 to receive liquid therefrom. The system 190' further includes a pipe 262, preferably buried beneath the level of the tank base 22, which fluidly connects the sump 260 to a liquid pumping system 266. The liquid pumping system 266 is preferably located outside of the tank 20 as shown in FIG. 13. A filter 268 covers the sump 260 to prevent granular insulation particles from entering the liquid control system 190'. A filter can be inserted in the pipe 262 to prevent granular material from reaching the pumping system 266.

The sump 260 can include a plurality of sumps, or be a continuous sump surrounding the tank with a plurality of pipes 262 fluidly connecting that single continuous sump to the liquid pumping system 266. In the case of a plurality of sumps, each sump is fluidly connected to a separate, or a single pumping system by a separate pipe 262 as suitable. The filters are arranged accordingly. Thus, each of the plurality of sumps has a separate filter, and the single continuous sump has a single continuous filter thereover. The number of sumps can correspond to the number of overflow pipes if so desired.

The filters include metal grating covered with a glass fiber blanket, or fabric such as glass woven fabric, in the above-disclosed embodiments, but other materials can also be used. The area beneath the FIG. 7 embodiment filter has filtering material located therein, but externally of the cage 204.

The tank 20 is shown in FIG. 13 and is surrounded by an earth berm B. It is also noted that while the outer tank is herein disclosed as being concrete, other materials, such as steel, or the like, can be used without departing from the scope of the present invention.

Figure 11:
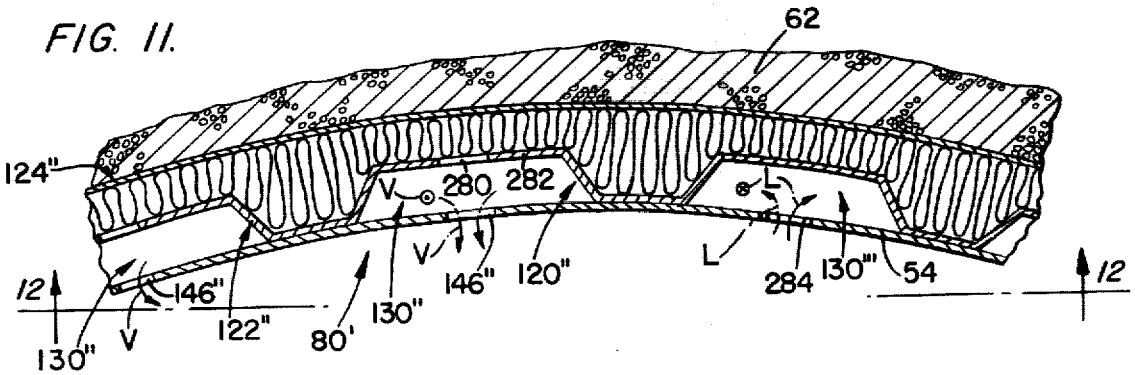
FIG. 11 is an alternative embodiment of the double containment tank overflow control system embodying the teachings of the present invention.
Figure 12:
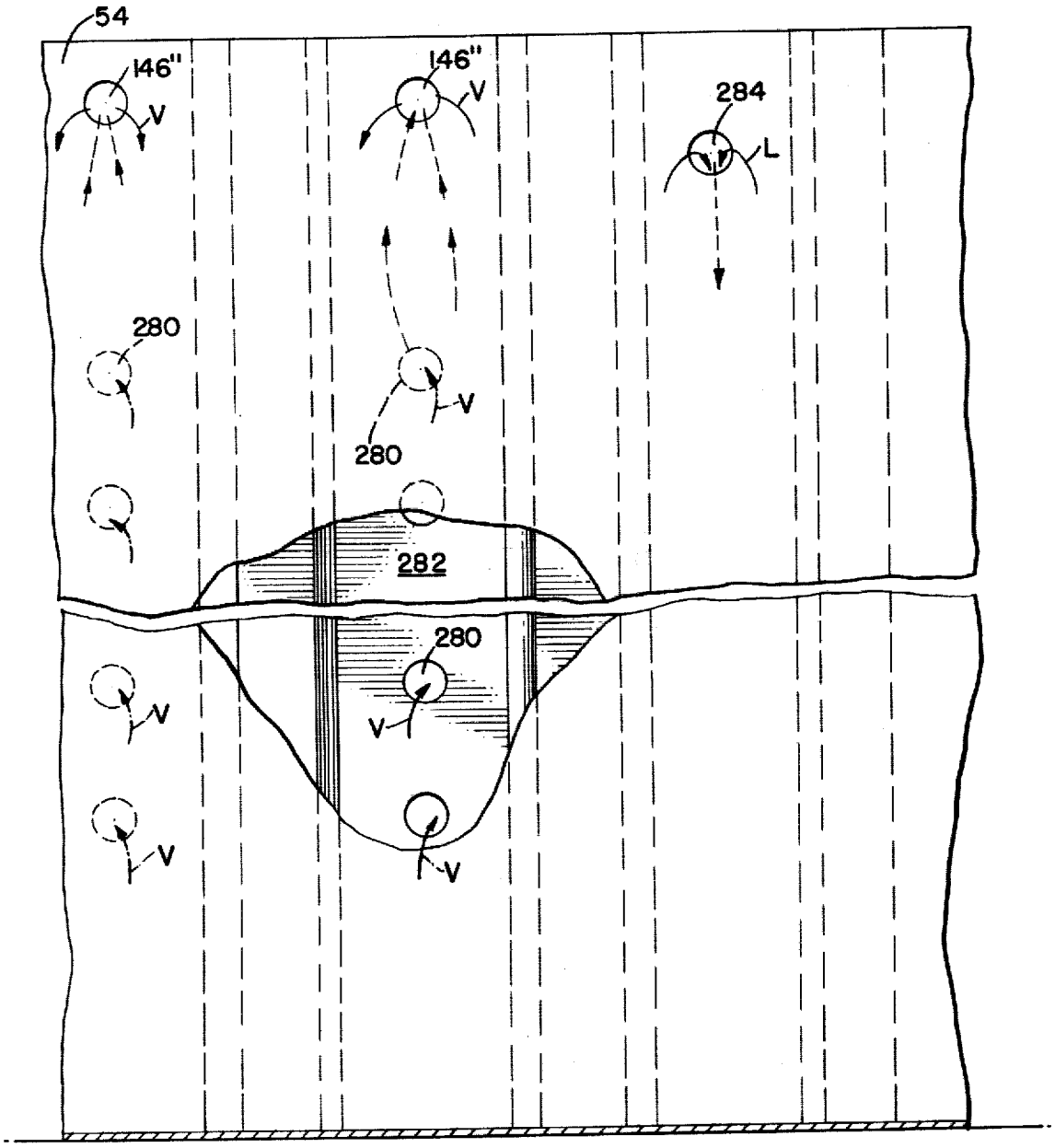
FIG. 12 is a view taken along line 12—12 of FIG. 11.

Yet another alternative embodiment of the overflow control system is shown in FIGS. 11 and 12. The overflow control system shown in these figures is indicated by the reference indicator 80' and includes a glass fiber compaction control blanket 120'' having an inner layer 122'' attached to the inner tank wall 54 at various locations, an outer layer 124'' contacting the granular insulation and extending for part of the height of the tank, preferably eight to ten feet, as above discussed. The blanket 120'' is similar in operation and function to the blanket 120 discussed above, but differs slightly in structure therefrom. The blanket 120'' is longitudinally corrugated, like the blankets 120 and 120', but has a plurality of holes defined in inner layer 122''. As best shown in FIG. 12, the blanket 120'' covers a plurality of vertically spaced apart vapor flow ports 280 defined in a wall 282 of the vapor ducts 130'' defined by those corrugations. Furthermore, a vapor hole 146'' is defined in the tank wall 54 to conduct vapor back into the inner tank for disposal therefrom by a suitable vapor disposal system. Vapor generated by the liquid overflow flows through these ports 280 into the ducts 130'' and to the interior of the tank 52 to be disposed of as above discussed.

The interior tank wall 54 has a plurality of liquid ports 284 defined thereon near the top thereof. The ports are fluidly connected with liquid ducts 130''' and are located near the top of the wall 54 at a location spaced below the vapor ports 146'' so that liquid will flow through the ports 284 and vapor will flow through ports 146''. The ports 284 correspond to the ports 86 which fluidly connect the rim girder interior 106 to the overflow pipe 82. As shown in FIG. 12, the vapor ports extend essentially the entire length of the wall 282 to at or near the bottom of the inner tank. One liquid port is associated with the liquid duct defining blanket corrugations, as shown in FIGS. 11 and 12.

Liquid flows downwardly in each duct 130''' while vapor flows upwardly in the ducts 130''. Thus, in the FIG. 11 embodiment, there is no overflow pipe similar to the overflow pipe 88. Filters, similar to filter 150 shown in FIG. 2, can be used to deflect the vapor back into the ducts 130''.

The above-discussed variations in blanket structure, and the like, are applicable to the alternative embodiments as well.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

We claim:

1. In a double wall tank for the storage of low temperature fluids, including an inner wall defining an inner tank, an outer wall, and an annular space between the inner and outer walls of the tank substantially filled with granular insulating materials, a control system for controlling in the event of a spill into the annulus, flow of stored fluid into and out of said annulus and for controlling and directing vapors resulting therefrom including:

at least one conduit located in the annulus and having an inlet fluidly connected to the inner tank at an overflow level of the inner tank and an outlet end located in and fluidly communicating with the annulus, said conduit controllably directing the spilled liquid down the tank and into the annulus at the bottom of the annulus;

vapor channel defining means located in the annulus and having an inlet fluidly connected to an outlet of said conduit via the annulus, said vapor channel defining means defining at least one vapor channel for directing the vapor generated from the spilled liquid in the bottom of the annulus to the top of the annulus, said channel defining means including means filtering said vapor flowing in said vapor channel, and preventing flow of granular insulation into said vapor channel;

vapor directing means located in said vapor channel for directing the flow of said vapors out of the annulus at the top thereof; and vapor venting means fluidly connected to said vapor directing means.

2. The control system defined in claim 1 further including a weir mounted on said inner tank wall.

3. The control system defined in claim 1 wherein said vapor channel defining means further includes a compaction control blanket.

4. The control system defined in claim 3 wherein said blanket includes a layer of glass fiber.

5. The control system defined in claim 3 wherein said blanket is corrugated with corrugations extending longitudinally of said inner tank.

6. The control system defined in claim 5 further including corrugation support means mounted on said inner tank for maintaining said corrugations.

7. The control system defined in claim 5 wherein said conduit and said vapor channel defining means are formed by blanket corrugations.

8. The control system defined in claim 7 further including at least one liquid port defined in the inner tank wall near the top thereof, and a plurality of vapor ports defined in said blanket.

9. The control system defined in claim 8 wherein said vapor ports are vertically spaced apart and are located for essentially the entire length of said blanket.

10. The control system defined in claim 3 wherein said blanket includes an outer layer extending for a portion of the height of the tank.

11. The control system defined in claim 10 further including an expanded metal grating on said blanket.

12. The control system defined in claim 10 further including a perforated plate on said blanket.

13. The control system defined in claim 12 wherein some of said perforations are polygonal.

14. The control system defined in claim 12 wherein said perforations are circular.

15. The control system defined in claim 3 wherein said blanket is mounted on the inside surface of said outer wall.

16. The control system defined in claim 1 further including a filter in said annulus.

17. The control system defined in claim 1 wherein said vapors exiting said vapor channel are directed into said inner tank and disposed of by a vapor control system associated with said inner tank.

18. The control system defined in claim 1 wherein said control system further includes a liquid control system for conducting liquid out of said annulus.

19. The control system defined in claim 18 further including a filter located in said annulus.

20. The control system defined in claim 18 wherein said liquid control system includes a pumping system having a riser pipe fluidly associated with said conduit.

21. The control system defined in claim 20 further including a liquid trap cage surrounding said conduit, said riser pipe having one end thereof located within said cage.

22. The control system defined in claim 21 wherein said cage includes an expanded metal layer and a layer of glass fiber mounted on said expanded metal layer.

23. The control system defined in claim 21 including a plurality of liquid traps.

24. The control system defined in claim 20 wherein said liquid control system includes a gravity assisted system which has a sump fluidly associated with said conduit.

25. The control system defined in claim 24 further including a pumping means associated with said sump and a pipe fluidly connecting said pumping means to said sump.

26. The control system defined in claim 24 further including a filter in said annulus located above the outlet of said conduit.

27. The control system defined in claim 24 further including a filter covering said sump.

28. The control system defined in claim 1 further including an insulation layer on the inner surface of said outer wall.

29. The control system defined in claim 1 wherein the side wall of the double wall tank is surrounded by earth.

30. The control system defined in claim 1 wherein an earthen berm surrounds said tank.

31. The control system defined in claim 1 wherein said vapor control channel surrounds said inner tank wall in an essentially continuous manner.

32. The control system defined in claim 3 wherein said corrugations are trapezoidal in shape.

33. The control system defined in claim 1 wherein means for preventing flow of granular insulation is a fabric layer.

34. The control system defined in claim 33 wherein said fabric layer includes woven glass.

35. The control system defined in claim 1 wherein said vapor venting means has less resistance to vapor flow than does said vapor channel defining means.

36. The control system defined in claim 1 including a gas directing means in the bottom of said annulus, said gas directing means directing gas generated in the initial evaporation of spilled liquid to said vapor channel.

37. The control system defined in claim 36 wherein said gas directing means has a heat flow resistance comparable to that of the granular insulating materials.

38. The control system defined in claim 1 wherein said vpaor channel defining means includes an outlet fluidly connected to the inner tank and the vapor is conducted into the inner tank by said vapor channel defining means.

* * * * *